US008874001B2

(12) United States Patent
Motomura

(10) Patent No.: US 8,874,001 B2
(45) Date of Patent: Oct. 28, 2014

(54) IMAGE FORMING APPARATUS

(71) Applicant: Oki Data Corporation, Tokyo (JP)

(72) Inventor: Mikio Motomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/649,265

(22) Filed: Oct. 11, 2012

(65) Prior Publication Data

US 2013/0101313 A1 Apr. 25, 2013

(30) Foreign Application Priority Data

Oct. 21, 2011 (JP) ..... 2011-231692

(51) Int. Cl.
*G03G 15/00* (2006.01)
*G03G 5/147* (2006.01)
*G03G 5/05* (2006.01)

(52) U.S. Cl.
CPC ..... *G03G 5/0592* (2013.01); *G03G 15/75* (2013.01); *G03G 2215/00957* (2013.01); *G03G 5/14795* (2013.01); *G03G 5/0564* (2013.01); *G03G 5/14756* (2013.01); *G03G 5/0596* (2013.01)
USPC ..... 399/159

(58) Field of Classification Search
USPC ..... 399/71, 128, 159; 430/58.05, 63
See application file for complete search history.

(56) References Cited

U.S. PATENT DOCUMENTS 5,436,101 A * 7/1995 Fender et al. ..... 430/65
6,148,165 A * 11/2000 Visser et al. ..... 399/223
7,514,192 B2 * 4/2009 Duff et al. ..... 430/59.1
2003/0059694 A1 * 3/2003 Tomiuchi et al. ..... 430/59.6
2009/0061341 A1 * 3/2009 Kim et al. ..... 430/59.4
2010/0183332 A1 * 7/2010 Zhao et al. ..... 399/159
2011/0058850 A1 * 3/2011 Shibuya ..... 399/128
2011/0229808 A1 * 9/2011 Yu et al. ..... 430/56

FOREIGN PATENT DOCUMENTS

JP 2005-208223 A 8/2005
JP 2009104122 A * 5/2009

OTHER PUBLICATIONS

Aizawa, Kouichi, et al. "A Study of 1-dot Latent Image Potential". Fuji Electric Review, vol. 51 No. 1, pp. 30-36.*

* cited by examiner

*Primary Examiner* — Clayton E Laballe
*Assistant Examiner* — Trevor J Bervik
(74) *Attorney, Agent, or Firm* — Muncy, Geissler, Olds & Lowe, P.C.

(57) ABSTRACT

An image forming apparatus includes a photosensitive body carrying an electrostatic latent image on a surface thereof, a charge device charging the surface of the photosensitive body, an exposure device forming the electrostatic latent image on the photosensitive body, a development device developing the electrostatic latent image so that a developer image is formed, and a transfer device transferring the developer image on a print medium. Wherein, a positive charge dark decay rate of the photosensitive body is greater than a negative charge dark decay rate when a dark decay rate is expressed by $$\frac{|V0| - |V5|}{|V0|} \times 100(\%)$$

where V0 [V] is a surface potential of the photosensitive body immediately after a completion of the charging by the charge device, and V5 [V] is the surface potential when the photosensitive body is left in a dark place for 5 seconds immediately after the completion of the charging.

14 Claims, 13 Drawing Sheets

Ghost Evaluation Results

| Sample | Pos. Chrg. Dark Decay Rate (%) | Neg. Chrg. Dark Decay Rate (%) | L/v=0.03[s] Ghost Level | L/v=0.04[s] Ghost Level | L/v=0.06[s] Ghost Level |
|---|---|---|---|---|---|
| Sample 1 | 2.8 | 2.1 | ○ | ○ | ○ |
| Sample 2 | 4.7 | 1.8 | ○ | ○ | ○ |
| Sample 3 | 2.3 | 4.7 | × | × | ○ |
| Sample 4 | 2.4 | 3.9 | × | × | ○ |
| Sample 5 | 1.9 | 3.2 | × | × | ○ |
| Sample 6 | 3.5 | 2.8 | ○ | ○ | ○ |
| Sample 7 | 4.1 | 3.3 | ○ | ○ | ○ |
| Sample 8 | 3.2 | 2.5 | ○ | ○ | ○ |
| Sample 9 | 1.8 | 3.7 | × | × | ○ |
| Sample 10 | 1.8 | 2.2 | × | × | ○ |

Ghost Evaluation Results

| Sample | Pos. Chrg. Dark Decay Rate (%) | Neg. Chrg. Dark Decay Rate (%) | L/v=0.03[s] Ghost Level | L/v=0.04[s] Ghost Level | L/v=0.06[s] Ghost Level |
|---|---|---|---|---|---|
| Sample 1 | 2.8 | 2.1 | ○ | ○ | ○ |
| Sample 2 | 4.7 | 1.8 | ○ | ○ | ○ |
| Sample 3 | 2.3 | 4.7 | × | × | ○ |
| Sample 4 | 2.4 | 3.9 | × | × | ○ |
| Sample 5 | 1.9 | 3.2 | × | × | ○ |
| Sample 6 | 3.5 | 2.8 | ○ | ○ | ○ |
| Sample 7 | 4.1 | 3.3 | ○ | ○ | ○ |
| Sample 8 | 3.2 | 2.5 | ○ | ○ | ○ |
| Sample 9 | 1.8 | 3.7 | × | × | ○ |
| Sample 10 | 1.8 | 2.2 | × | × | ○ |

Fig. 9

Ghost Evaluation Results For Initial Printing

| Sample | Pos. Chrg. Dark Decay Rate (%) | Neg. Chrg. Dark Decay Rate (%) | 0.6 μ J/cm² Ghost Level | 1.2 μ J/cm² Ghost Level | 2.4 μ J/cm² Ghost Level | 4.8 μ J/cm² Ghost Level | 7.2 μ J/cm² Ghost Level |
|---|---|---|---|---|---|---|---|
| Sample 1 | 2.8 | 2.1 | × | ○ | ○ | ○ | ○ |
| Sample 2 | 4.7 | 1.8 | × | ○ | ○ | ○ | ○ |
| Sample 3 | 2.3 | 4.7 | × | × | × | × | × |
| Sample 4 | 2.4 | 3.9 | × | × | × | × | × |
| Sample 5 | 1.9 | 3.2 | × | × | × | × | × |
| Sample 6 | 3.5 | 2.8 | × | ○ | ○ | ○ | ○ |
| Sample 7 | 4.1 | 3.3 | × | ○ | ○ | ○ | ○ |
| Sample 8 | 3.2 | 2.5 | × | ○ | ○ | ○ | ○ |
| Sample 9 | 1.8 | 3.7 | × | × | × | × | × |
| Sample 10 | 1.8 | 2.2 | × | × | × | × | × |

Fig. 10 A

Other Print Quality Results For Initial Printing

| Sample | Pos. Chrg. Dark Decay Rate (%) | Neg. Chrg. Dark Decay Rate (%) | 0.6 μ J/cm² Other Print Level | 1.2 μ J/cm² Other Print Level | 2.4 μ J/cm² Other Print Level | 4.8 μ J/cm² Other Print Level | 7.2 μ J/cm² Other Print Level |
|---|---|---|---|---|---|---|---|
| Sample 1 | 2.8 | 2.1 | O | O | O | O | O |
| Sample 2 | 4.7 | 1.8 | O | O | O | O | O |
| Sample 3 | 2.3 | 4.7 | O | O | O | O | O |
| Sample 4 | 2.4 | 3.9 | O | O | O | O | O |
| Sample 5 | 1.9 | 3.2 | O | O | O | O | O |
| Sample 6 | 3.5 | 2.8 | O | O | O | O | O |
| Sample 7 | 4.1 | 3.3 | O | O | O | O | O |
| Sample 8 | 3.2 | 2.5 | O | O | O | O | O |
| Sample 9 | 1.8 | 3.7 | O | O | O | O | O |
| Sample 10 | 1.8 | 2.2 | O | O | O | O | O |

Fig. 10 B

Ghost Evaluation Results After Printing 20,000 Sheets

| Sample | Pos. Chrg. Dark Decay Rate (%) | Neg. Chrg. Dark Decay Rate (%) | 0.6 μ J/cm² Ghost Level | 1.2 μ J/cm² Ghost Level | 2.4 μ J/cm² Ghost Level | 4.8 μ J/cm² Ghost Level | 7.2 μ J/cm² Ghost Level |
|---|---|---|---|---|---|---|---|
| Sample 1 | 2.8 | 2.1 | × | ○ | ○ | ○ | ○ |
| Sample 2 | 4.7 | 1.8 | × | ○ | ○ | ○ | ○ |
| Sample 3 | 2.3 | 4.7 | × | × | × | × | × |
| Sample 4 | 2.4 | 3.9 | × | × | × | × | × |
| Sample 5 | 1.9 | 3.2 | × | × | × | × | × |
| Sample 6 | 3.5 | 2.8 | × | ○ | ○ | ○ | ○ |
| Sample 7 | 4.1 | 3.3 | × | ○ | ○ | ○ | ○ |
| Sample 8 | 3.2 | 2.5 | × | ○ | ○ | ○ | ○ |
| Sample 9 | 1.8 | 3.7 | × | × | × | × | × |
| Sample 10 | 1.8 | 2.2 | × | × | × | × | × |

Fig. 11 A

Other Print Quality Results After Printing 20,000 Sheets

| Sample | Pos. Chrg. Dark Decay Rate (%) | Neg. Chrg. Dark Decay Rate (%) | 0.6 μ J/cm² Other Print Level | 1.2 μ J/cm² Other Print Level | 2.4 μ J/cm² Other Print Level | 4.8 μ J/cm² Other Print Level | 7.2 μ J/cm² Other Print Level |
|---|---|---|---|---|---|---|---|
| Sample 1 | 2.8 | 2.1 | ○ | ○ | ○ | ○ | × |
| Sample 2 | 4.7 | 1.8 | ○ | ○ | ○ | ○ | × |
| Sample 3 | 2.3 | 4.7 | ○ | ○ | ○ | △ | × |
| Sample 4 | 2.4 | 3.9 | ○ | ○ | ○ | △ | × |
| Sample 5 | 1.9 | 3.2 | ○ | ○ | ○ | △ | × |
| Sample 6 | 3.5 | 2.8 | ○ | ○ | ○ | ○ | × |
| Sample 7 | 4.1 | 3.3 | ○ | ○ | ○ | ○ | × |
| Sample 8 | 3.2 | 2.5 | ○ | ○ | ○ | ○ | × |
| Sample 9 | 1.8 | 3.7 | ○ | ○ | ○ | △ | × |
| Sample 10 | 1.8 | 2.2 | ○ | ○ | ○ | △ | × |

Fig. 11 B

IMAGE FORMING APPARATUS

CROSS REFERENCE TO RELATED APPLICATION

The present application is related to, claims priority from and incorporates by reference Japanese Patent Application No. 2011-231692, filed on Oct. 21, 2011.

TECHNICAL FIELD

The present invention relates to an image forming apparatus using an electrographic process.

BACKGROUND

With demands for downsizing and high speed processes, a conventional image forming apparatus, such as a printing device, a copy machine, a facsimile machine and the like, that forms an image using an electrographic process, includes a photosensitive drum and performs printing by repeating, as an image forming process, a charging process by which a surface of the photosensitive drum is uniformly charged by a charge device, an exposure process by which the charged surface of the photosensitive drum is exposed by an exposure device to form an electrostatic latent image, a development process by which the formed electrostatic latent image is developed by a development device to form a toner image, and a transfer process by which the developed toner image is transferred to a transferred material, such as a sheet, by a transfer device.

In such an image forming process, to prevent an image defect due to a ghost formed by a potential difference at exposed parts and non-exposed parts on the surface of the photosensitive drum, a discharging light device that has a light source, such as a light emitting diode (LED) and the like, is arranged between the transfer device and the charge device to perform a discharging process by which the electric potential on the photosensitive drum is removed by irradiating the discharging light prior to the charging process. (See, for example, JP Laid-Open Patent Application No. 2005-208223 (Paragraphs [0013]-[0029] and FIGS. 1 and 2)

However, image quality is degraded if the photosensitive drum is not sufficiently discharged prior to the discharging process.

An object of the detailed examples disclosed in the present invention is to improve the above-described image quality.

SUMMARY

An image forming apparatus includes a photosensitive body that is configured to carry an electrostatic latent image on a surface thereof; a charge device that is configured to charge the surface of the photosensitive body, an exposure device that is configured to form the electrostatic latent image on the photosensitive body charged by the charge device, a development device that is configured to develop the electrostatic latent image formed on the photosensitive body by the exposure device so that a developer image is formed, and a transfer device that is configured to transfer the developer image formed on the photosensitive body by the development device on a print medium, wherein a positive charge dark decay rate of the photosensitive body is greater than a negative charge dark decay rate when a dark decay rate is expressed by $$\frac{|V0| - |V5|}{|V0|} \times 100(\%)$$

where V0 [V] is a surface potential of the photosensitive body immediately after a completion of the charging by the charge device, and V5 [V] is the surface potential when the photosensitive body is left in a dark place for 5 seconds immediately after the completion of the charging.

The detailed examples disclosed in the present invention improve the above-described image quality.

BRIEF DESCRIPTION OF THE DRAWINGS

FIG. 9 is an explanatory diagram illustrating a photosensitive drum evaluation result in the first embodiment.

FIGS. 10A and 10B are explanatory diagrams illustrating the photosensitive drum evaluation result with initial printing in a second embodiment.

FIGS. 11A and 11B are explanatory diagrams illustrating the photosensitive drum evaluation result after printing 20,000 sheets in the second embodiment.

DETAILED DESCRIPTION OF EMBODIMENTS

Embodiments of an image forming apparatus according to the present invention are explained below with reference to figures.

First Embodiment

Figure 2:
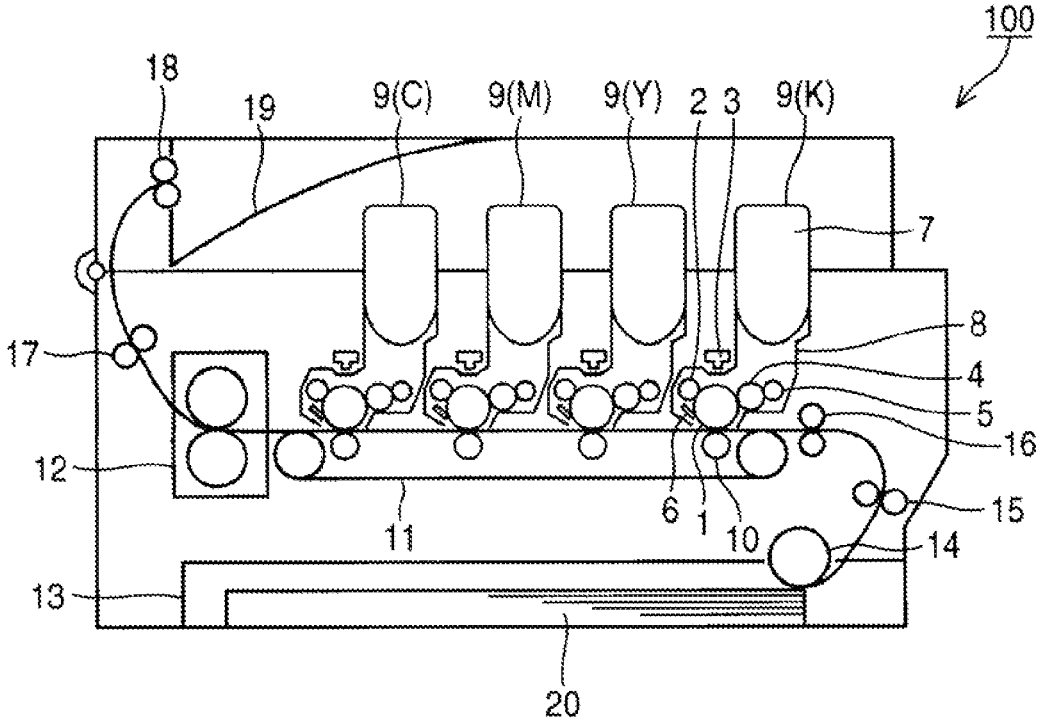
FIG. 2 is a schematic side cross-sectional diagram illustrating a configuration of an image forming apparatus in the first embodiment.

FIG. 2 is a schematic side cross-sectional diagram illustrating a configuration of an image forming apparatus in the first embodiment.

In FIG. 2, reference numeral 100 refers to an image forming apparatus, such as a printer, a photocopy machine, a facsimile machine and the like, that forms an image by using an electrographic process. In the present embodiment, the image forming apparatus 100 is explained as a printer.

Print media 20 are accommodated in a sheet supply cassette 13 of the image forming apparatus 100. An S-shaped carrying path for the print media 20 is arranged to pass from a sheet supply roller 14, through carrying rollers 15 and carrying rollers 16, between photosensitive drums 1 of image forming units 9 and a transfer belt 11, through carrying rollers 17 and ejection rollers 18, and to an ejection part 19. The image forming units 9 that form developer (toner) images in four colors are arranged in order of black (K), yellow (Y), magenta (M) and cyan (C) from the upstream side of the carrying path. Regarding the print media, there is no restriction on quality, size or material. The print medium may be bond paper, recycled paper, gloss paper, matte paper, overhead-projector (OHP) films, which is made of a plastic, or the like. Further, in the application, the print medium is disclosed as a sheet, but the print medium may be a roll.

On each print medium 20, a toner image formed on the photosensitive drum 1 is transferred in each image forming unit 9 at a contact part of the photosensitive drum 1 and the transfer roller 10 provided to face the photosensitive drum 1 across the transfer belt 11, when the print medium 20 passes between the photosensitive drum 1 of each image forming unit 9 and the transfer belt 11.

The print medium 20 on which the toner image has been transferred is carried to a fusion device 12. The transferred toner image is fixed onto the print medium 20 at the fusion device 12 by heat and pressure. The print medium 20 on which the toner image has been fixed is ejected outside the apparatus by the carrying rollers 17 and the ejection rollers 18 and accommodated in the ejection part 19.

Figure 3:
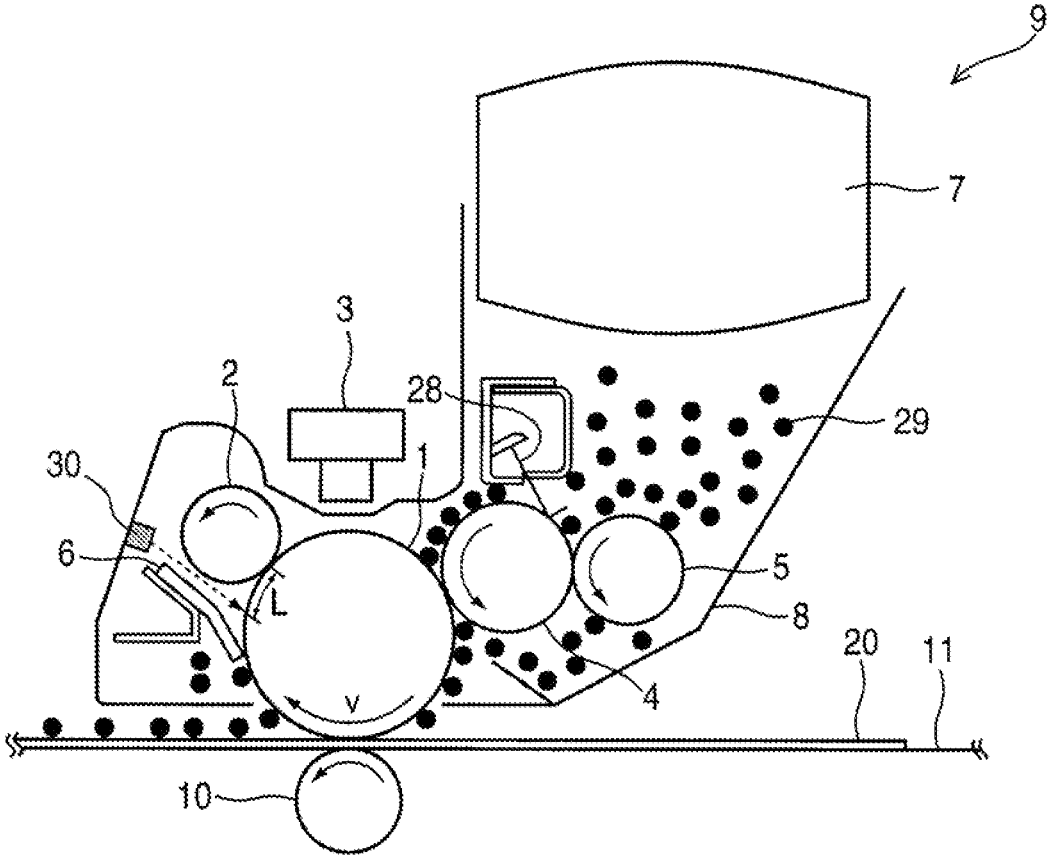
FIG. 3 is a schematic cross-sectional diagram illustrating a configuration of an image forming unit in the first embodiment.

FIG. 3 is a schematic cross-sectional diagram illustrating a configuration of an image forming unit in the first embodiment.

In FIG. 3, the image forming unit 9 includes a toner cartridge 7 and a drum cartridge 8. The drum cartridge 8 is configured from a photosensitive drum 1 as a photosensitive body that carries an image, a charge roller 2 as a charge device that negatively charges a surface of the photosensitive drum 1, a development roller 4 as a development device that forms a toner image as a developer image on an electrostatic latent image formed by an exposure light emitting diode (LED) head 3 as an exposure device on the photosensitive drum 1 charged by the charge roller 2, a development blade 28 that forms an even layer of the toner 29 as developer on the development roller 4, a sponge roller 5 as a supply member for mixing and negatively charging the toner 29, a cleaning blade 6 for cleaning the remaining toner on the surface of the photosensitive drum 1 after transfer, and a discharging light device 30 as a discharge device that radiates discharging light on the surface of the photosensitive drum 1 to discharge the electric potential on the surface of the photosensitive drum 1. In the present embodiment, using the sponge roller 5 that contacts the development roller 4, the toner 29 is negatively charged by being frictionally charged between the development roller 4 and the sponge roller 5.

The discharging light device 30 is arranged at a position to radiate the discharging light on the surface of the photosensitive drum 1 after transfer of the toner image by the transfer roller 10 as the transfer device, but prior to charging by the charge roller 2 as the charge device (in the present embodiment, between the cleaning blade 6 and the charge roller 2).

The exposure LED head 3 for forming the electrostatic latent image on the photosensitive drum 1 is arranged on the main body of the image forming apparatus 100 to expose the photosensitive drum 1 from a predetermined position relative to the drum cartridge 8. In the present embodiment, a positive voltage is applied to the transfer roller 10 to transfer the toner image formed by the negatively charged toner.

Onto the print medium 20 as a transferred body that has been carried by the transfer belt 11, a toner image developed on the electrostatic latent image on the photosensitive drum 1 is transferred at the contact part between the photosensitive drum 1 and the transfer roller 10 as the transfer device positioned on other side across the transfer belt 11.

The photosensitive drum 1, the charge roller 2, the development roller 4, the sponge roller 5 and the transfer roller 10 perform an image forming process for forming an image on the print medium 20 by rotating in the respective directions indicated by arrows in the figure.

Figure 1A:
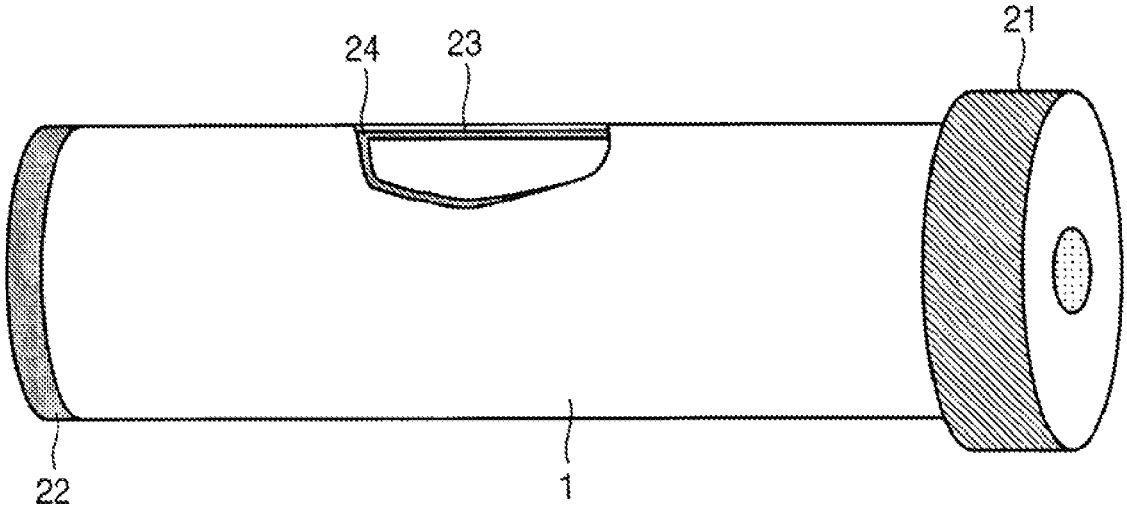
FIGS. 1A and 1B are explanatory diagrams illustrating a configuration of a photosensitive drum in a first embodiment.
Figure 1B:
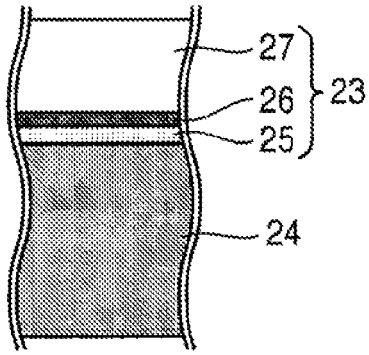

FIGS. 1A and 1B are explanatory diagrams illustrating a configuration of the photosensitive drum in the first embodiment. FIG. 1A is a perspective view of the photosensitive drum, and FIG. 1B is a cross-sectional view of a conductive support body and a photosensitive layer part of the photosensitive drum.

In FIGS. 1A and 1B, the photosensitive drum 1 includes a drum gear 21, a drum flange 22, and a photosensitive layer part 23 in which a photoconductive layer is applied on a conductive support body 24 processed in a cylindrical shape. The photosensitive layer part 23 has a stacked configuration of, in order from the surface of the conductive support body 24, a blocking layer 25 that prevents the electric charges from the conductive support body 24 from flowing in, an electric charge generation layer 26 having exposure sensitivity, and an electric charge transportation layer 27 that moves the electric charges generated at the electric charge generation layer 26 to the surface.

Next, a manufacturing process for the photosensitive drum is explained with reference to FIGS. 1A and 1B in accordance with Step 1 to Step 8 in the explanatory diagram of FIG. 4 which illustrates a photosensitive drum manufacturing process according to the first embodiment.

Step 1: First, an aluminum alloy, which is a raw material for the conductive support body, and which is a JIS-A3000 type aluminum alloy pillet that is an alloy in which silicon is mixed in aluminum in the present embodiment, is processed in an extruded tube using a porthole method. (Aluminum tube extrusion)

Step 2: By cutting the extruded tube processed at Step 1, a cylindrical conductive support body 24 (hereinafter also called "aluminum tube 24") is produced with predetermined thickness and outer diameter (in the present embodiment, outer diameter: 30 mm; length: 246 mm; thickness 0.75 mm), and the surface is polished (Aluminum tube surface polishing).

Step 3: The aluminum tube 24 produced at Step 2 is carried to a washing tank for a surface washing treatment to sufficiently remove oil and various dust and the like attached to the surface. (Washing)

Step 4: The blocking layer 25 is formed on the surface of the sufficiently washed aluminum tube 24. In the present embodiment, the blocking layer 25 (hereinafter also called "anodized aluminum layer 25") is formed with anodic oxide coating with a thickness of approximately 6 μm by performing an anodic oxidation treatment and then a sealing treatment using nickel acetate as a main component (Blocking layer formation (Anodized aluminum treatment)).

Step 5: The electric charge generation layer 26 is formed on the anodized aluminum layer 25 formed at Step 4. The electric charge generation layer 26 is formed by a dip coating method in which the aluminum tube 24 on which the anodized aluminum layer 25 has been formed is dipped, for coating, in a tank filled with an electric charge generation layer coating solution prepared in advance. In the present embodiment, the aluminum tube 24 is coated by the dip coating method so that the electric charge generation layer 26 is formed with a thickness of approximately 0.3 μm (Electric charge generation layer dip coating).

The electric charge generation layer coating solution used in the present embodiment is prepared by adding 10 parts by weight of oxotitanium phthalocyanine to 150 parts by weight of 1,2-dimethoxyethane; by mixing 100 parts by weight of a binder solution with 5% solid content density, in which 5 parts by weight of polyvinyl butylal is dissolved in 95 parts by weight of 1,2-dimethoxyethane, in 160 parts by weight of a pigment dispersion solution produced by crush dispersion treatment using a sand grind mill; and finally by adjusting the mixture so that the solid content density becomes 4% and that a weight ratio of 1,2-dimethoxyethane and 4-methoxy-4-methyl pentanone-2 becomes 9:1.

Step 6: The aluminum tube 24 in which the electric charge generation layer 26 is formed on the anodized aluminum layer 25 at Step 5 is dried to remove unnecessary solvent in the electric charge generation layer 26 and to fix the electric charge generation layer 26 on the anodized aluminum layer 25. (Drying)

Step 7: Next, an electric charge transportation layer 27 that includes a binder resin as a topmost surface layer is formed on the electric charge generation layer 26. The electric charge transportation layer 27 is formed by the dip coating method in which the aluminum tube 24 on which the electric charge generation layer 26 has been formed at Step 6 is dipped, for coating, in a tank filled with the electric charge transportation layer coating solution prepared in advance. In the present embodiment, the aluminum tube 24 is coated by the dip coating method so that the electric charge transportation layer 27 is formed with a thickness of approximately 18 μm (Electric charge transportation layer dip coating).

The electric charge transportation layer coating solution is a solution in which the binder resin and electric charge transportation substance are mainly dissolved. In the present embodiment, samples of the photosensitive drum were produced using the later-discussed electric charge transportation layer coating solution.

Step 8: The electric charge transportation layer 27 that is dip-coated on the electric charge generation layer 26 at Step 7 is dried to remove unnecessary solvent in the electric charge transportation layer 27 and to fix the electric charge generation layer 27 on the electric charge generation layer 26. (Drying)

The photosensitive drum is produced through processes in Steps 1 through 8.

Next, samples 1 to 10 of the photosensitive drum produced in the present embodiment are explained below.

<Sample 1>

Sample 1 of the photosensitive drum was produced in accordance with the manufacturing process shown in above-described FIG. 4 using a solution, as the electric charge transportation layer coating solution, in which 100 parts by weight of polycarbonate resin indicated by below Chemical Formula 1 as the binder resin and 70 parts by weight of the electric charge transportation substance indicated by below Chemical Formula 5 as the electric charge transportation substance were dissolved in a mixed solvent of tetrahydrofran:toluene=80:20 (weight ratio).

[Chemical Formula 1]

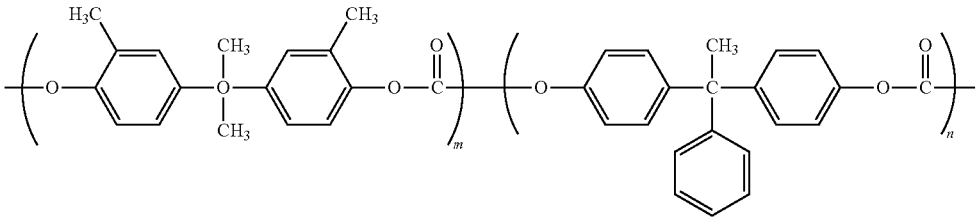

(m:n = 1:1)

[Chemical Formula 5]

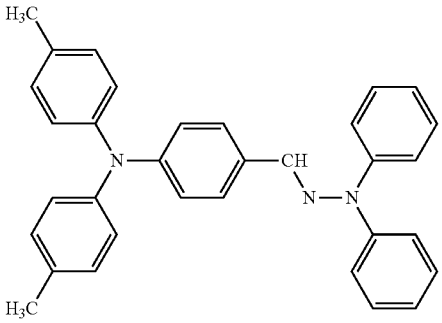

<Sample 2>

Figure 4:
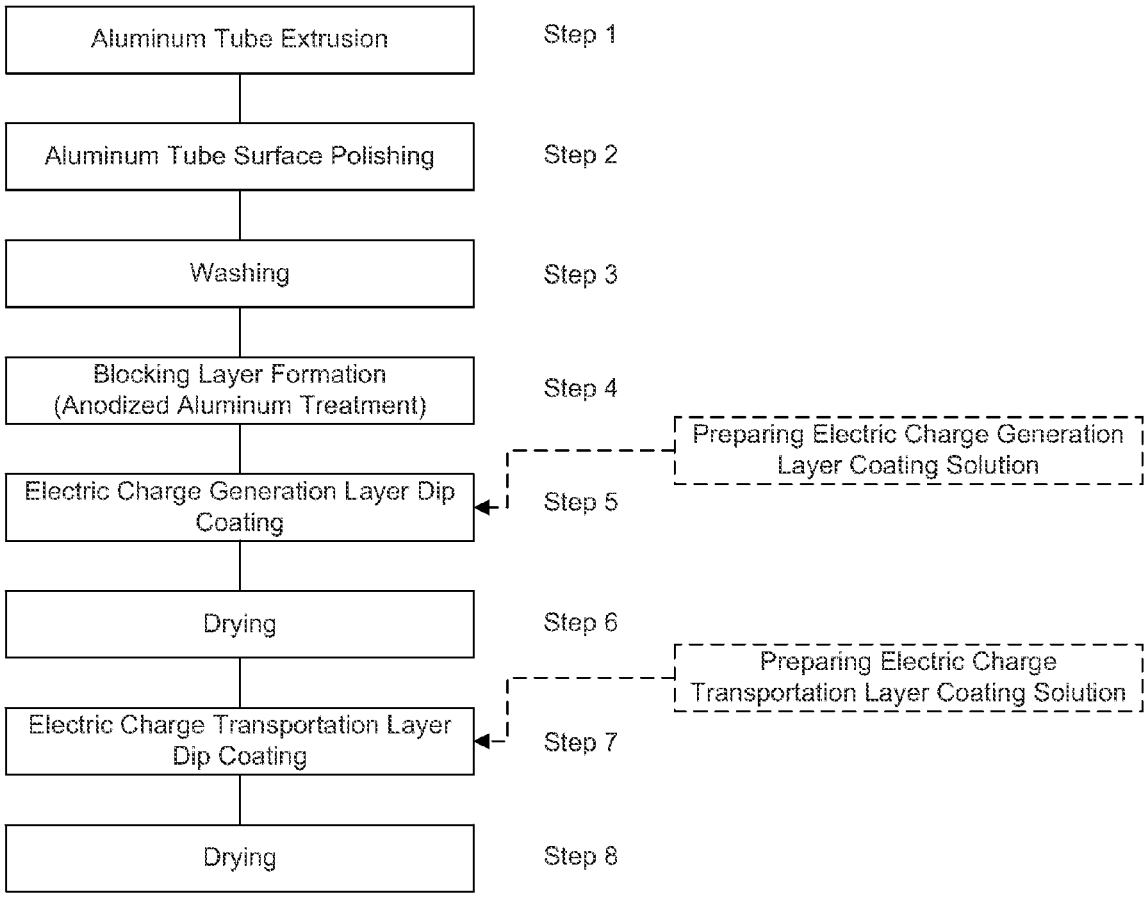
FIG. 4 is an explanatory diagram illustrating a photosensitive drum manufacturing process in the first embodiment.

Sample 2 of the photosensitive drum was produced in accordance with the manufacturing process shown in above-described FIG. 4 using a solution, as the electric charge transportation layer coating solution, in which 100 parts by weight of the polycarbonate resin indicated by above Chemical Formula 1 as the binder resin, 70 parts by weight of the electric charge transportation substance indicated by above Chemical Formula 5 as the electric charge transportation substance, and 1 part by weight of an additive indicated by below Chemical Formula 9 as an additive were dissolved in the mixed solvent of tetrahydrofran:toluene=80:20 (weight ratio).

[Chemical Formula 9]

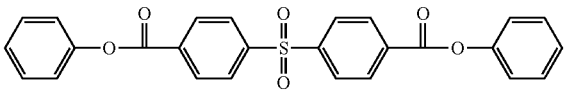

<Sample 3>

Sample 3 of the photosensitive drum was produced in accordance with the manufacturing process shown in above-described FIG. 4 using a solution, as the electric charge transportation layer coating solution, in which 100 parts by weight of polycarbonate resin indicated by below Chemical Formula 2 as the binder resin, 40 parts by weight of an electric charge transportation substance indicated by below Chemical Formula 6 as the electric charge transportation substance, and 30 parts by weight of an electric charge transportation substance indicated by below Chemical Formula 7 were dissolved in the mixed solvent of tetrahydrofran:toluene=80:20 (weight ratio).

[Chemical Formula 2]

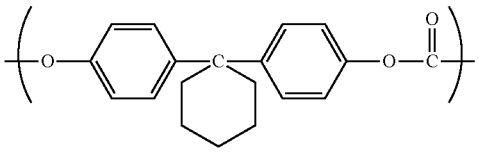

[Chemical Formula 6]

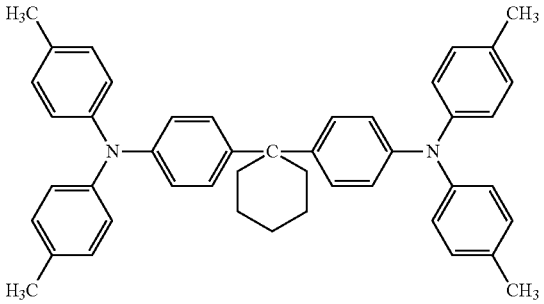

-continued

[Chemical Formula 7]

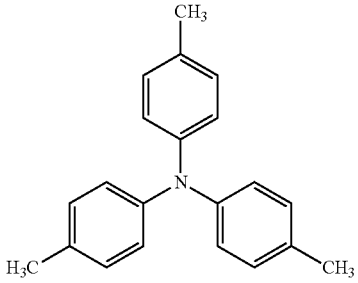

<Sample 4>

Sample 4 of the photosensitive drum was produced in accordance with the manufacturing process shown in above-described FIG. 4 using a solution, as the electric charge transportation layer coating solution, in which 100 parts by weight of the polycarbonate resin indicated by above Chemical Formula 2 as the binder resin, 40 parts by weight of the electric charge transportation substance indicated by above Chemical Formula 6 and 30 parts by weight of the electric charge transportation substance indicated by above Chemical Formula 7 as the electric charge transportation substance, and 1 part by weight of the additive indicated by above Chemical Formula 9 as the additive were dissolved in the mixed solvent of tetrahydrofran:toluene=80:20 (weight ratio).

<Sample 5>

Sample 5 of the photosensitive drum was produced in accordance with the manufacturing process shown in above-described FIG. 4 using a solution, as the electric charge transportation layer coating solution, in which 100 parts by weight of polyarylate resin indicated by below Chemical Formula 3 as the binder resin and 50 parts by weight of an electric charge transportation substance indicated by below Chemical Formula 8 as the electric charge transportation substance were dissolved in the mixed solvent of tetrahydrofran:toluene=80:20 (weight ratio).

[Chemical Formula 3]

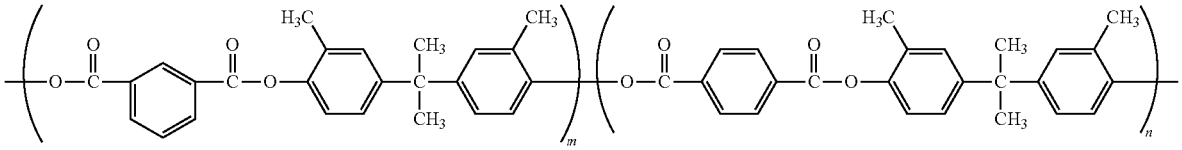

(m:n = 1:1)

[Chemical Formula 8]

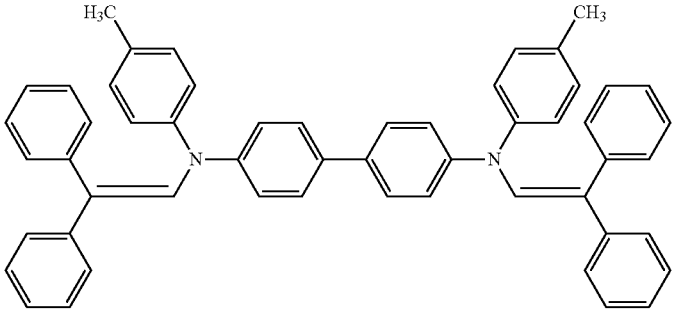

<Sample 6>

Sample 6 of the photosensitive drum was produced in accordance with the manufacturing process shown in above-described FIG. 4 using a solution, as the electric charge transportation layer coating solution, in which 100 parts by weight of the polyarylate resin indicated by above Chemical Formula 3 as the binder resin, 50 parts by weight of the electric charge transportation substance indicated by above Chemical Formula 8 as the electric charge transportation substance, and 1 part by weight of the additive indicated by above Chemical Formula 9 as the additive were dissolved in the mixed solvent of tetrahydrofran:toluene=80:20 (weight ratio).

<Sample 7>

Sample 7 of the photosensitive drum was produced in accordance with the manufacturing process shown in above-described FIG. 4 using a solution, as the electric charge transportation layer coating solution, in which 30 parts by weight of the polycarbonate resin indicated by above Chemical Formula 1 as the binder resin, 70 parts by weight of polyester resin indicated by below Chemical Formula 4, and 50 parts by weight of the electric charge transportation substance indicated by above Chemical Formula 5 as the electric charge transportation substance were dissolved in the mixed solvent of tetrahydrofran:toluene=80:20 (weight ratio).

[Chemical Formula 4]

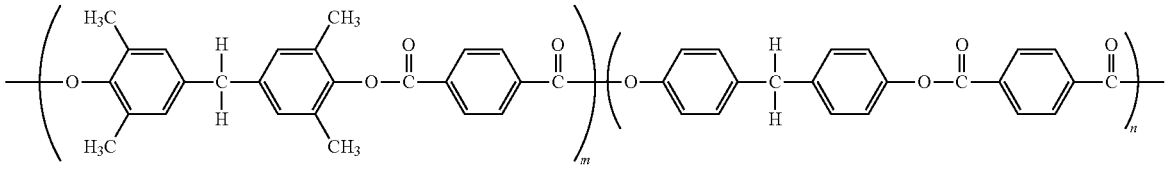

(m:n = 1:1)

<Sample 8>

Sample 8 of the photosensitive drum was produced in accordance with the manufacturing process shown in above-described FIG. 4 using a solution, as the electric charge transportation layer coating solution, in which 30 parts by weight of the polycarbonate resin indicated by above Chemical Formula 1 as the binder resin, 70 parts by weight of the polyester resin indicated by above Chemical Formula 4, 50 parts by weight of the electric charge transportation substance indicated by above Chemical Formula 5 as the electric charge transportation substance, and 1 part by weight of the additive indicated by above Chemical Formula 9 as the additive were dissolved in the mixed solvent of tetrahydrofran:toluene=80:20 (weight ratio).

<Sample 9>

Sample 9 of the photosensitive drum was produced in accordance with the manufacturing process shown in above-described FIG. 4 using a solution, as the electric charge transportation layer coating solution, in which 30 parts by weight of the polycarbonate resin indicated by above Chemical Formula 2 as the binder resin, 70 parts by weight of the polyester resin indicated by above Chemical Formula 4, 30 parts by weight of the electric charge transportation substance indicated by above Chemical Formula 6 and 20 parts by weight of the electric charge transportation substance indicated by above Chemical Formula 7 as the electric charge transportation substance were dissolved in the mixed solvent of tetrahydrofran:toluene=80:20 (weight ratio).

<Sample 10>

Sample 10 of the photosensitive drum was produced in accordance with the manufacturing process shown in above-described FIG. 4 using a solution, as the electric charge transportation layer coating solution, in which 30 parts by weight of the polycarbonate resin indicated by above Chemical Formula 2 as the binder resin, 70 parts by weight of the polyester resin indicated by above Chemical Formula 4 and 30 parts by weight of the electric charge transportation substance indicated by above Chemical Formula 6 as the electric charge transportation substance, 20 parts by weight of the electric charge transportation substance indicated by above Chemical Formula 7, and 1 part by weight of the additive indicated by above Chemical Formula 9 as the additive were dissolved in the mixed solvent of tetrahydrofran:toluene=80:20 (weight ratio).

Figure 5:
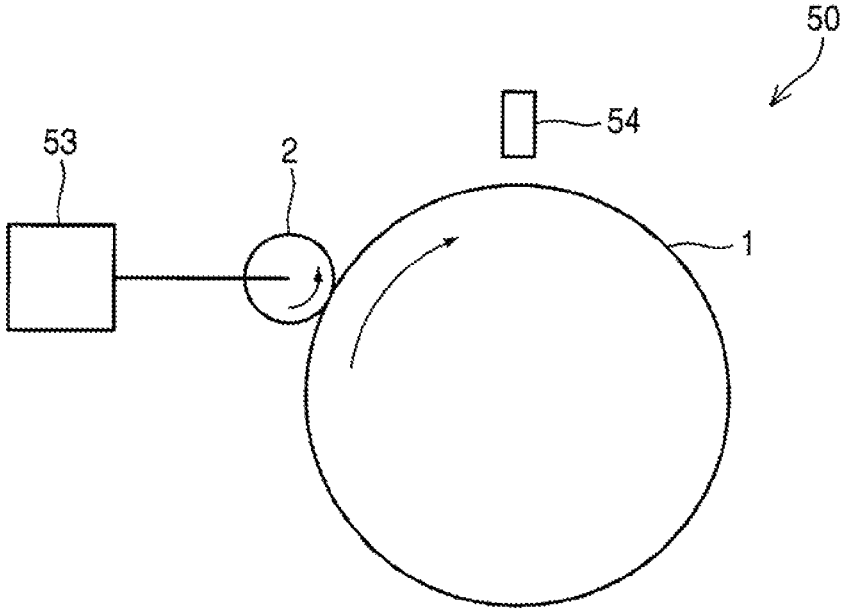
FIG. 5 is an explanatory diagram illustrating a dark decay rate measuring method in the first embodiment.
Figure 6:
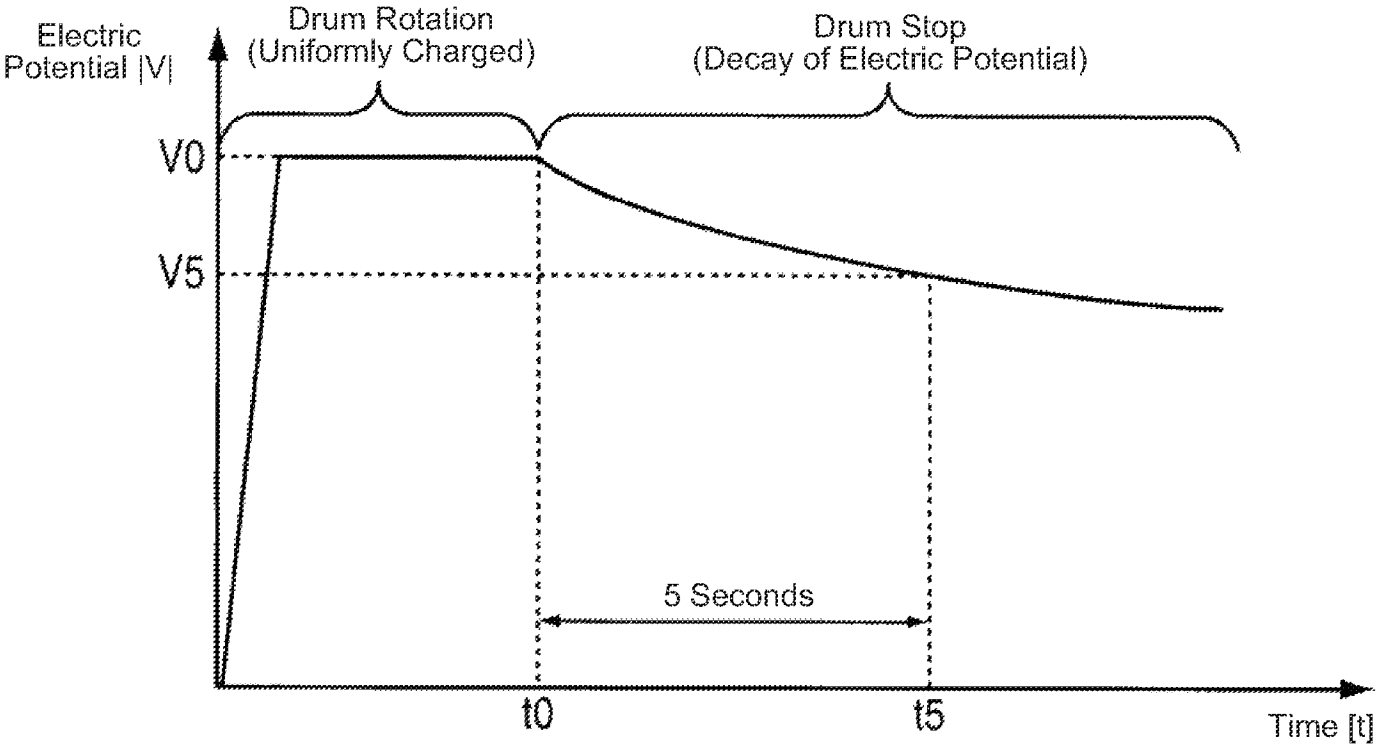
FIG. 6 is an explanatory diagram illustrating the dark decay rate measuring method in the first embodiment.

Next, a measuring method for a dark decay rate in case when each of Samples 1-10 of the photosensitive drum produced is positively charged and in case when each of them is negatively charged is explained based on explanatory diagrams of FIGS. 5 and 6 that illustrate a dark decay rate measuring method in the first embodiment.

In FIG. 5, a dark decay rate measurement device 50 is a device that measures a dark decay rate of the photosensitive drum and is configured from the photosensitive drum 1 as a measured object, the charge roller 2 that charges the photosensitive drum 1, a power source 53 that applies voltage to the charge roller 2, and a surface electrometer 54 that measures a surface potential of the photosensitive drum 1.

The photosensitive drum 1 is a sample of the photosensitive drum that is arranged freely rotatably in the direction indicated by the arrow in the figure by a driving device (not shown) and that is positioned to contact the charge roller 2 so that the charge roller 2 is driven by the photosensitive drum 1. As a voltage is applied to the charge roller 2 from the power source 53, the photosensitive drum 1 that rotates is charged. The surface potential of the photosensitive drum 1 is measured by the surface electrometer 54 (Model 344 by Trek Japan) that is positioned in the downstream of the charge roller 2 in the rotational direction of the photosensitive drum 1 and that establishes no contact with the photosensitive drum 1.

The dark decay measurement device 50 as configured above is placed in a dark environment, and a voltage applied from the power source 53 to the charge roller 2 is adjusted while the photosensitive drum 1 is rotated at a rotational speed of 100 rpm in the direction indicated by the arrow in the figure so that the surface potential of the photosensitive drum 1 is V0=+700 V in case of positive charge and V0=−700 V in case of negative charge.

The rotation of the photosensitive drum 1 is stopped immediately after the surface of the photosensitive drum 1 is uniformly charged at an absolute value of plus and minus

|V0|=700 V. With the time when the rotation is stopped being t0, the absolute value |V5| of the surface potential of the photosensitive drum 1 is measured at time t5 after 5 seconds from time t0. That is, the surface potential of the photosensitive drum 1 immediately after the completion of the charging by the charge roller 2 is defined as V0 [V], and the surface potential of the photosensitive drum 1 when leaving the photosensitive drum 1 in a dark place for 5 seconds immediately after the charging is defined as V5 [V]. Then, the dark decay rate of the photosensitive drum 1 is calculated with the following equation:

$$\text{Dark Decay Rate } (\%) = \frac{|V0| - |V5|}{|V0|} \times 100(\%) \quad \text{(Equation)}$$

By calculating the dark decay rate of the photosensitive drum 1 as described above, the electric charge holding characteristics in the electric charge transportation layer 27 of the photosensitive drum 1 shown in FIG. 1 can be compared between the positive charge when the surface of the photosensitive drum 1 is positively charged, and the negative charge when the surface of the photosensitive drum 1 is negatively charged. If the dark decay rate is greater, the electric charge in the electric charge transportation layer 27 indicates tendency to easily disperse, disappear and move. In contrast, if the dark decay rate is smaller, the electric charge in the electric charge transportation layer 27 indicates tendency to stay.

Operation of the above-described configuration is explained.

Figure 7:
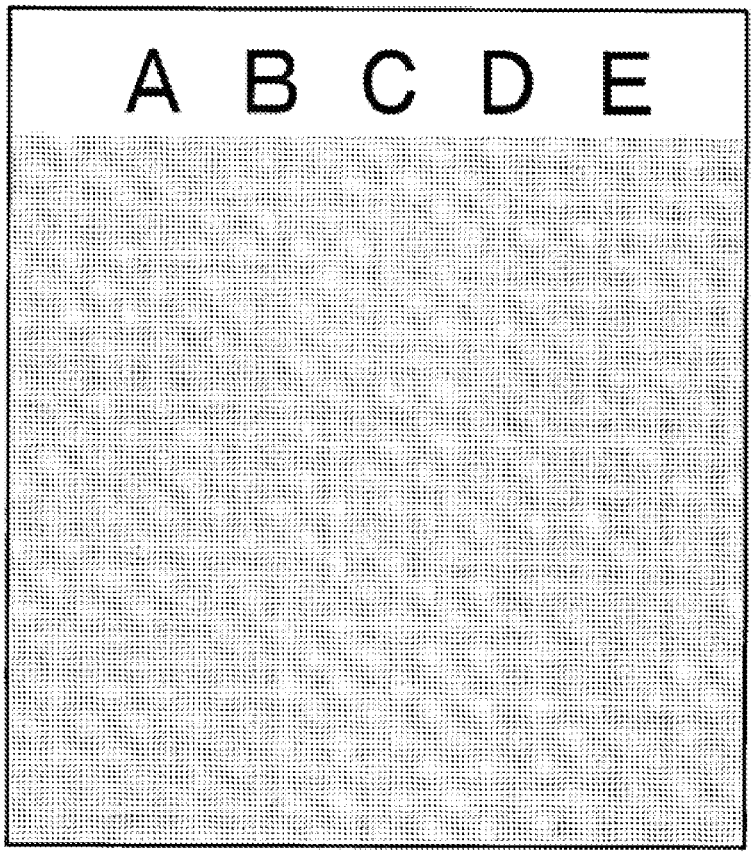
FIG. 7 is an explanatory diagram of a print pattern in the first embodiment.

For the 10 types of the photosensitive drum samples 1 to 10 produced based on the above-described manufacturing processes, and using the image forming apparatus shown in FIG. 2, ghost evaluation was conducted by printing a print pattern shown in FIG. 7 under a low-temperature low-humidity environment (temperature: 10° C.; humidity: 20%), which is in general the toughest environment for the ghost evaluation that evaluates occurrence of ghost during printing.

The print pattern shown in FIG. 7 includes a pattern of a character array in bold on a white background in a region of an approximately 50 mm width from the top end of a printable region of the sheet, and a half-tone (30% print density in the present embodiment) pattern in a region below approximately 50 mm from the top end to the low end side of the printable region of the sheet, as a normal office use an A4-size plain paper copier (PPC) sheet is printed in portrait orientation.

As conditions for the image formation process in the ghost evaluation, irradiation light amount of the discharging light by the discharging light device is fixed at 2.4 $\mu J/cm^2$, and a distance L [mm] is adjusted so that L/v is 0.06 [s], 0.04 [s] and 0.03 [s], where L [mm] is a distance between the discharging light irradiation position on the surface of the photosensitive drum and a contact position between the photosensitive drum and the charge roller as shown in FIG. 3, and v [mm/s] is a velocity of a point of the surface of the photosensitive drum during the print operation. Other conditions for the image forming process are the same. With such conditions, print results were compared.

Figure 8:
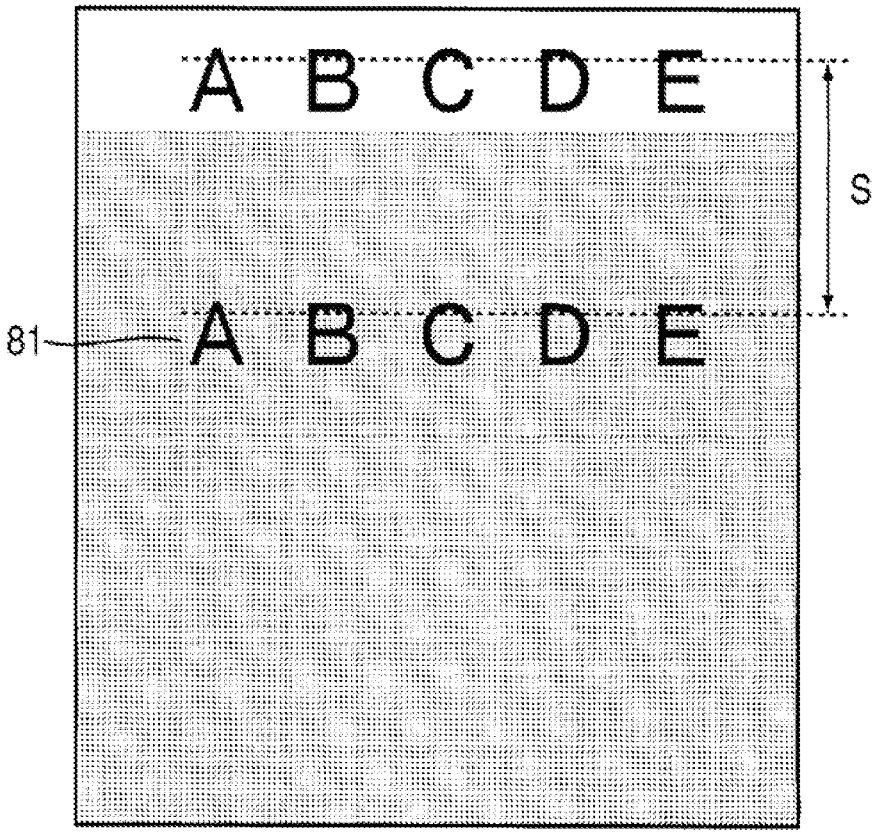
FIG. 8 is an explanatory diagram of a ghost in the first embodiment.

As shown in FIG. 8, the occurrence of the ghost based on the print results is determined by whether or not, with a rotational cycle S of the photosensitive drum, a potential difference on the surface of the photosensitive drum appears in the print result of the half-tone print pattern for the second rotation of the photosensitive drum, at an exposed part that corresponds to the bold character array pattern and an unexposed part that corresponds to the white background of the first rotation of the photosensitive drum. As a determination standard, the print result shows "○" if a print of a ghost 81 was not visibly recognized and "x" if the ghost print 81 was visibly recognized. Occurrence of the ghost is referred to as a ghost level in the print result.

FIG. 9 is an explanatory diagram illustrating a photosensitive drum evaluation result in the first embodiment. FIG. 9 shows the positive charge dark decay rate (%), a negative charge dark decay (%), and ghost levels for L/v=0.03, 0.04 and 0.06 [s] for each of the photosensitive drum samples 1 to 10.

The positive charge dark decay rate (%) and the negative charge dark decay rate (%) are the dark decay rates (%) calculated based on the measurement using the dark decay measurement method as explained in FIGS. 5 and 6. The respective ghost levels at L/v=0.03, 0.04 and 0.06 [s] are results of evaluation of occurrence of the ghost in the above-described print result.

As shown in FIG. 9, when the ghost level is L/v=0.06 [s], an excellent print result was obtained for each of the photosensitive drum samples 1 to 10. However, for L/v=0.04 [s] or less, the excellent print result was obtained only with the photosensitive drum samples that satisfy a condition A>B, where A (%) is the positive charge dark decay rate, and B (%) is the negative charge dark decay rate.

This is because, if the time that the surface of the photosensitive drum moves from the discharging process to the charging process is 0.06 [s], there is a sufficient amount of time for the positive charges injected near the surface of the photosensitive drum and in the photosensitive layer (the electric charge generation layer 26 and the electric charge transportation layer 27 shown in FIG. 1B) and the positive charges generated in the electric charge generation layer 26 shown in FIG. 1B due to the irradiation of the discharging light, to discharge the surface potential of the photosensitive drum by dispersion or disappearance in the electric charge transportation layer 27. Therefore, the potential difference between the exposed part and the unexposed part of the first cycle was small at the time of image formation for the second cycle of the photosensitive drum, and thereby the ghost print did not appear.

In contrast, it is considered that, when the movement time of the surface of the photosensitive drum from the discharging process to the charging process is 0.04 [s] or less, the potential difference between the exposed part and the unexposed part of the first rotation becomes great with the photosensitive drum that does not satisfy the above-described condition A>B during the image formation on the photosensitive drum during the second rotation because the movement time of the surface of the photosensitive drum from the discharging process to the charging process is short. Therefore, the ghost print appears. It is considered that, the potential difference between the exposed part and the unexposed part of the first cycle becomes small with the photosensitive drum that satisfies the above-described condition A>B. Therefore, the excellent print result is obtained as the ghost print does not appear.

In addition, in the 10 photosensitive drum samples, the ghost print did not occur in Samples 1, 2, 7 and 8, in which polycarbonate resin of above-described Chemical Equation 1 as the binder resin. The ghost print occurred in Samples 3, 4, 7, 9 and 10, in which polycarbonate resin of above-described Chemical Equation 2 as the binder resin. These presumably indicate that a larger molecular weight of a structural unit of the polycarbonate resin used as the binder resin indicated by the above-described chemical equation that is calculated based on an atomic table (The Chemical Society of Japan, 2011), tends to satisfy the above-described condition A>B.

In general, a molecular weight of a structural unit of generic polycarbonate resin formed from bisphenol A and phosgene is approximately 254, while a molecular weight of a structural unit of the polycarbonate resin indicated by above-described Chemical Equation 1 is approximately 598. In addition, a molecular weight of a structural unit of the polycarbonate resin indicated by above-described Chemical Equation 2 is approximately 273.

Therefore, in general, compared with the molecular weight (approximately 254) of the structural unit of the generic polycarbonate resin formed from bisphenol A and phosgene that is calculated based on the atomic table, it is presumed that use of the polycarbonate resin having the structural unit of which molecular weight is approximately 508 or more, which is twice of the above-described molecular weight, is more effective.

As described above, to obtain an excellent print result with no ghost in a compact image forming apparatus with high image forming process speed, a photosensitive drum that satisfies the condition A>B, where A is the positive charge dark decay rate A (%) of the photosensitive drum and B is the negative charge dark decay rate B (%) of the photosensitive drum, is the most appropriate.

As such, an excellent print result without the ghost is obtained by using the photosensitive drum that satisfies the condition A>B, where A is the positive charge dark decay rate A (%) of the photosensitive drum and B is the negative charge dark decay rate B (%), that is, the photosensitive drum whose positive charge dark decay rate is greater than the negative charge dark decay rate.

As explained above, in the first embodiment, there is an advantage that an excellent print result without the ghost is obtained with the compact image forming apparatus with high image forming process speed, by using in the image forming apparatus a photosensitive drum that satisfies the condition A>B, where A is the positive charge dark decay rate A (%) of the photosensitive drum and B is the negative charge dark decay rate B (%).

Second Embodiment

In a second embodiment, an appropriate irradiation light amount for the discharging light by the discharging light device 30 shown in FIG. 3 is regulated in the image forming process for the ghost evaluation conducted by printing the print pattern shown in FIG. 7 under the low-temperature low-humidity environment (temperature: 10° C.; humidity: 20%), which is in general the toughest environment for the ghost evaluation that evaluates occurrence of ghost during printing with the 10 types of the photosensitive drum samples 1 to 10 produced based on the above-described manufacturing processes explained in the first embodiment, and using the image forming apparatus 100 shown in FIG. 2.

The configuration of the second embodiment is similar to the configuration of the first embodiment. Therefore, explanation of parts that are the same is omitted by assigning the same symbols.

Operation of the second embodiment is explained.

The print pattern shown in FIG. 7 includes the pattern of the character array in bold on the white background in the region of an approximately 50 mm width from the top end of the printable region of the sheet, and the half-tone (30% print density in the present embodiment) pattern in the region below approximately 50 mm from the top end to the low end side of the printable region of the sheet, as a normal office use an A4-size plain paper copier (PPC) sheet is printed in portrait orientation.

In general, it is known that, if the light amount of the discharging light is too much, degradation for the characteristics of the photosensitive drum occurs due to light-induced fatigue caused by the printing, causing print defects, such as reduced print density and insufficient contrast, to temporarily occur.

In the present embodiment, with the light amount of the discharging light being set to 5 standards (0.6 $\mu J/cm^2$, 1.2 $\mu J/cm^2$, 2.4 $\mu J/cm^2$, 4.8 $\mu J/cm^2$, and 7.2 $\mu J/cm^2$), a 20,000-sheet print durability evaluation was conducted under a condition that L/v is fixed to 0.04 [s] where L [mm] is a distance between a discharging light irradiation position on the surface of the photosensitive drum and a contact position at which the surface of the photosensitive drum contact the charge roller, and v [mm/s] is a velocity on the surface of the photosensitive drum during the print operation. An evaluation of the ghost at the initial period and after printing 20,000 sheets and checking of other print qualities (e.g., decrease in print density and insufficient contrast other than the ghost print) were performed.

Similar to the first embodiment, the occurrence of the ghost based on the print results is determined by whether or not, with the rotational cycle S of the photosensitive drum shown in FIG. 8, a potential difference on the surface of the photosensitive drum appears in the print result of the half-tone print pattern for the second rotation of the photosensitive drum, at an exposed part that corresponds to the bold character array pattern and an unexposed part that corresponds to the white background of the first rotation of the photosensitive drum. As a determination standard, the print result shows "○" if a print of the ghost 81 was not visibly recognized and "x" if the ghost print 81 was visibly recognized.

Moreover, for checking the print qualities other than the ghost print, a level at which the print defects, such as decrease in print density or insufficient contrast, are not recognized with eye is indicated by "○", a level at which the print defects are recognized but not substantial for the actual use is indicated by "Δ", and a level at which the print defects are obviously significant is indicated by "x".

FIGS. 10A and 10B are explanatory diagrams illustrating the photosensitive drum evaluation result with initial printing in the second embodiment, and FIGS. 11A and 11B are explanatory diagrams illustrating the photosensitive drum evaluation result after printing 20,000 sheets in the second embodiment. FIGS. 10A, 10B, 11A and 11B indicate the positive charge dark decay rate (%), the negative charge dark decay rate (%), respective ghost levels with the discharging light amounts 0.6 $\mu J/cm^2$, 1.2 $\mu J/cm^2$, 2.4 $\mu J/cm^2$, 4.8 $\mu J/cm^2$, and 7.2 $\mu J/cm^2$, and print quality levels other than the ghost for the photosensitive drum samples 1 to 10.

The positive charge dark decay rate (%) and the negative charge dark decay rate (%) are dark decay rates (%) measured and calculated by the dark decay rate measurement method explained by FIGS. 5 and 6 in the first embodiment. The ghost levels with the discharging light amounts 0.6 μJ/cm$^2$, 1.2 μJ/cm$^2$, 2.4 μJ/cm$^2$, 4.8 μJ/cm$^2$, and 7.2 μJ/cm$^2$ are results of evaluating the occurrence of the ghost in the above-described print results, and the print quality levels other than the ghost with the discharging light amounts 0.6 μJ/cm$^2$, 1.2 μJ/cm$^2$, 2.4 μJ/cm$^2$, 4.8 μJ/cm$^2$, and 7.2 μJ/cm$^2$ are results of evaluating the print quality in the above-described print results.

As shown in FIG. 10A, for the ghost evaluation at the initial printing, when the discharging light amount is 0.6 μJ/cm$^2$, the ghost appeared with all of the photosensitive drum samples 1 to 10, and an excellent print result was not obtained. However, with the discharging light amount being 1.2 μJ/cm$^2$ or greater, the excellent print result was obtained without the ghost, with the photosensitive drum samples that satisfy the condition A>B, where A (%) is the positive charge dark decay rate, and B (%) is the negative charge dark decay rate.

Therefore, at least the discharging light amount that is 1.2 μJ/cm$^2$ or greater is the optimum. Moreover, as shown in FIG. 10B, for the initial printing, the decrease in the print density or the insufficient contrast, which are other than the ghost, did not occur.

In addition, as shown in FIG. 11A, for the ghost evaluation after printing 20,000 sheets for print durability, when the discharging light amount is 0.6 μJ/cm$^2$, the ghost appeared with all of the photosensitive drum samples 1 to 10, and an excellent print result was not obtained. However, with the discharging light amount being 1.2 μJ/cm$^2$ or greater, the excellent print result was obtained without the ghost, with the photosensitive drum samples that satisfy the condition A>B, where A (%) is the positive charge dark decay rate, and B (%) is the negative charge dark decay rate.

Therefore, after the print durability, at least the discharging light amount that is 1.2 μJ/cm$^2$ or greater is also the optimum.

Further, as shown in FIG. 11B, for the print quality after printing 20,000 sheets for printing durability other than the ghost, such as the decrease in the print density and the insufficient contrast, when the discharging light amount is 7.2 μJ/cm$^2$, the print defects, such as the decrease in the print density or the insufficient contrast, caused by degradation due to light-induced fatigue were recognized with all of the 10 photosensitive drum samples. When the discharging light amount is 4.8 μJ/cm$^2$, a small print defect was recognized, but not substantial for the actual use, with the photosensitive drum samples that does not satisfy the condition A>B, where A (%) is the positive charge dark decay rate, and B (%) is the negative charge dark decay rate. When the discharging light amount is 2.4 μJ/cm$^2$ or less, the print defects, such as the decrease in the print density or the insufficient contrast, caused by degradation due to light-induced fatigue were not recognized with all of the 10 photosensitive drum samples.

Therefore, at least the discharging light amount that is 4.8 μJ/cm$^2$ or less is the optimum in order to maintain the excellent print quality after the print durability.

As described above, to obtain an excellent print result with no ghost and an excellent print result without decrease in the print density and insufficient contrast caused by the degradation of the photosensitive drum due to light-induced fatigue in a compact image forming apparatus with high image forming process speed even after print durability, an image forming apparatus that includes a photosensitive drum that satisfies the condition A>B, where A is the positive charge dark decay rate A (%) of the photosensitive drum and B is the negative charge dark decay rate B (%) of the photosensitive drum, and that at least the discharging light amount is 1.2 μJ/cm$^2$ or more and 4.8 μJ/cm$^2$ or less, is the most appropriate.

As explained above, in the second embodiment, there is an advantage that an excellent print result without the ghost and an excellent print result without decrease in the print density and insufficient contrast caused by the degradation of the photosensitive drum due to light-induced fatigue are obtained with the compact image forming apparatus with high image forming process speed, by using the image forming apparatus that includes a photosensitive drum that satisfies the condition A>B, where A is the positive charge dark decay rate A (%) of the photosensitive drum and B is the negative charge dark decay rate B (%), and that at least the discharging light amount is 1.2 μJ/cm$^2$ or more and 4.8 μJ/cm$^2$ or less, is the most appropriate.

The first and second embodiments are explained with a printer as an image forming apparatus. However, such application is not limited to the printer but may be made in a photocopy machine, a facsimile machine, a multi function peripherals (MFP) and the like that that use the electrographic method.

What is claimed is:

1. An image forming apparatus, comprising:

a photosensitive body that is configured to carry an electrostatic latent image on a surface thereof;

a charge device that is configured to charge the surface of the photosensitive body;

an exposure device that is configured to form the electrostatic latent image on the photosensitive body charged by the charge device;

a development device that is configured to develop the electrostatic latent image formed on the photosensitive body by the exposure device so that a developer image is formed; and a transfer device that is configured to transfer the developer image formed on the photosensitive body by the development device on a print medium, wherein a positive charge dark decay rate of the photosensitive body is greater than a negative charge dark decay rate when a dark decay rate is expressed by $$\frac{|V0| - |V5|}{|V0|} \times 100(\%)$$

where V0 [V] is a surface potential of the photosensitive body immediately after a completion of the charging by the charge device, and V5 [V] is the surface potential when the photosensitive body is left in a dark place for 5 seconds immediately after the completion of the charging, wherein the positive charge dark decay rate is in a range from 2.8% to 4.7%, the negative charge dark decay rate is in a range from 1.8% to 3.3%, and the photosensitive body includes a topmost surface layer made of binder resin that includes polycarbonate resin formed by the following chemical formula:

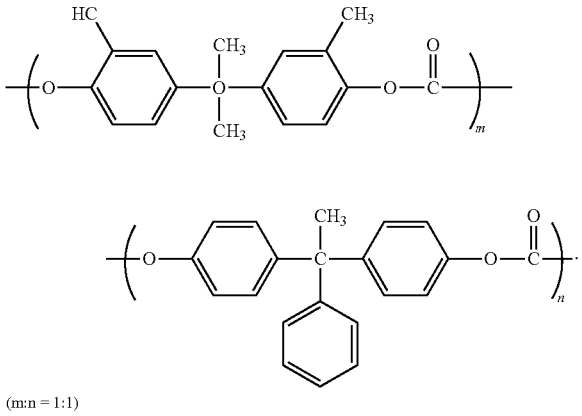

(m:n = 1:1)

2. The image forming apparatus according to claim 1, wherein the charge device negatively charges the surface of the photosensitive body.

3. The image forming apparatus according to claim 1, wherein a positive voltage is applied to the transfer device.

4. The image forming apparatus according to claim 1, wherein the photosensitive body includes a topmost surface layer made of binder resin, and the binder resin includes polycarbonate resin having a structural unit of which molecular weight is approximately 508 or more calculated based on an atomic table.

5. The image forming apparatus according to claim 1, wherein the positive charge dark decay rate and the negative charge dark decay rate of the photosensitive body are determined by using the photosensitive body, of which surface is charged at |V0|=700V.

6. The image forming apparatus according to claim 1, wherein the charge device comprises a single charge device, the exposure device comprises a single exposure device, and the development device comprises a single development device.

7. The image forming apparatus according to claim 1, wherein the photosensitive body includes a charge transportation layer forming the surface of the photosensitive body, and the charge transportation layer contains a charge transportation substance and binder resin.

8. The image forming apparatus according to claim 1, wherein the topmost surface layer of the photosensitive body includes an electric charge transportation substance indicated by the following chemical formula:

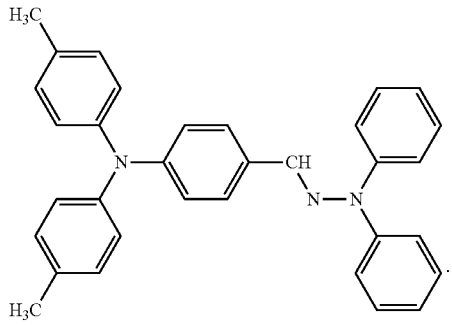

9. The image forming apparatus according to claim 1, wherein the topmost surface layer of the photosensitive body includes:

polyester resin indicated by the following chemical formula:

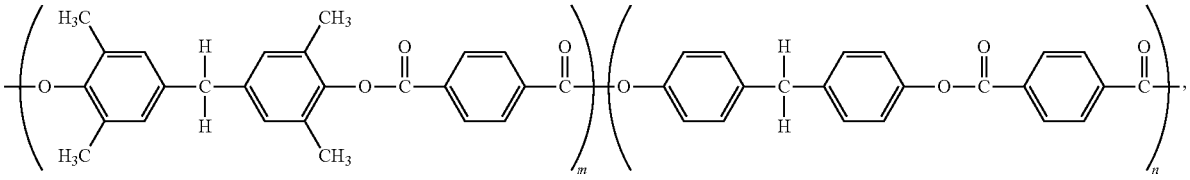

(m:n = 1:1)

and an electric charge transportation substance indicated by the following chemical formula:

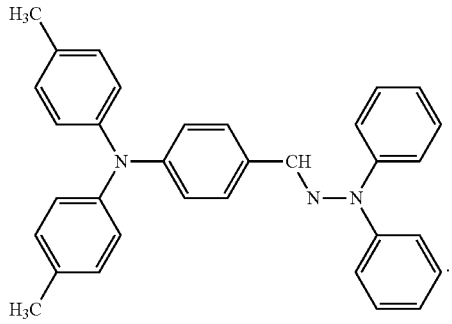

10. The image forming apparatus according to claim 1, further comprising:

a discharge device that is positioned between the transfer device and the charge device and that is configured to discharge the surface of the photosensitive body.

11. The image forming apparatus according to claim 10, wherein a formula below is satisfied:

$$L/v \leq 0.04 \text{ [s]}$$

where L [mm] is defined as a distance on the surface of the photosensitive body from a discharging light irradiation position to a contact position between the surface of the photosensitive body and the charge device, and v [mm/s] is defined as a velocity on the surface of the photosensitive body moving from the discharging light irradiation position to the contact position.

12. The image forming apparatus according to claim 10, wherein the discharge device is a discharging light device that radiates discharging light on the surface of the photosensitive body.

13. The image forming apparatus according to claim 12, wherein an amount of the discharging light is 1.2 μJ/cm$^2$ or more and 4.8 μJ/cm$^2$ or less.

14. An image forming apparatus, comprising:

a photosensitive body that is configured to carry an electrostatic latent image on a surface thereof;

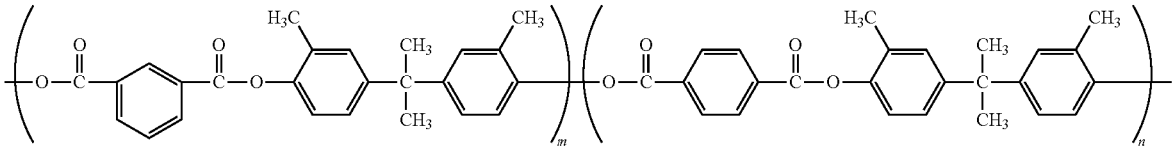

(m:n = 1:1)

a charge device that is configured to charge the surface of the photosensitive body;

an exposure device that is configured to form the electrostatic latent image on the photosensitive body charged by the charge device;

a development device that is configured to develop the electrostatic latent image formed on the photosensitive body by the exposure device so that a developer image is formed; and a transfer device that is configured to transfer the developer image formed on the photosensitive body by the development device on a print medium, wherein a positive charge dark decay rate of the photosensitive body is greater than a negative charge dark decay rate when a dark decay rate is expressed by $$\frac{|V0| - |V5|}{|V0|} \times 100(\%)$$

where V0 [V] is a surface potential of the photosensitive body immediately after a completion of the charging by the charge device, and V5 [V] is the surface potential when the photosensitive body is left in a dark place for 5 seconds immediately after the completion of the charging, wherein the positive charge dark decay rate is in a range from 2.8% to 4.7%, the negative charge dark decay rate is in a range from 1.8% to 3.3%, and the photosensitive body includes a topmost surface layer includes an additive indicated by the following chemical formula is added to the topmost surface layer:

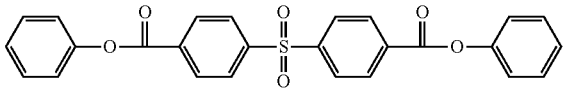

when the topmost surface layer is made of at least one of:

(1) binder resin that includes polyarylate resin formed by the following chemical formula:

and (2) an electric charge transportation substance indicated by the following chemical formula:

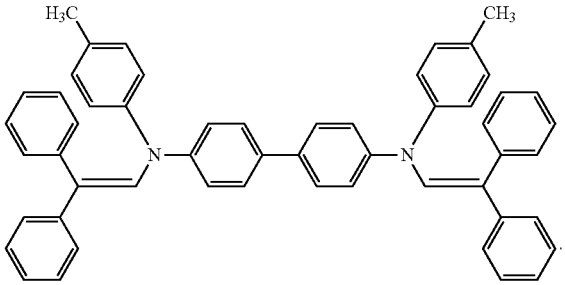

* * * * *